US008381667B2

(12) United States Patent
Gibowski

(10) Patent No.: US 8,381,667 B2
(45) Date of Patent: Feb. 26, 2013

(54) ADJUSTABLE, MULTIPLE SPLASH PLATE LIQUOR GUNS

(75) Inventor: Steven R. Gibowski, Pensacola, FL (US)

(73) Assignee: ALSTOM Technology Ltd, Baden (CH)

( * ) Notice: Subject to any disclaimer, the term of this patent is extended or adjusted under 35 U.S.C. 154(b) by 1018 days.

(21) Appl. No.: 12/371,080

(22) Filed: Feb. 13, 2009

(65) Prior Publication Data

US 2010/0206965 A1 Aug. 19, 2010

(51) Int. Cl.
*F23G 5/22* (2006.01)

(52) U.S. Cl. ..... 110/238; 110/348; 239/225.1; 239/587.1; 285/121.1; 285/128.1; 285/184; 285/283; 403/385; 403/399

(58) Field of Classification Search ..... 110/238, 110/348, 266, 239, 248; 285/273, 283, 121.1, 285/124.2, 124.3, 128.1, 184, 185, 394–396, 285/398–400; 403/83, 385–386, 389, 394–396, 403/398–400; 24/455, 335; 122/7 R; 239/225.1, 239/227, 587.1, 587.5; 279/282
See application file for complete search history.

(56) References Cited

U.S. PATENT DOCUMENTS

| | | | | |
|---|---|---|---|---|
| 1,917,031 | A * | 7/1933 | Hamilton | 239/420 |
| 2,161,111 | A * | 6/1939 | Wilcoxson et al. | 239/227 |
| 2,555,337 | A * | 6/1951 | Hamm | 422/109 |
| 2,636,813 | A | 4/1953 | Singleton, Jr. | |
| 3,215,099 | A | 11/1965 | Coulter, Jr. | |
| 3,421,462 | A * | 1/1969 | Wessberg | 110/238 |
| 3,795,475 | A * | 3/1974 | Hellstrom | 431/1 |
| 4,462,319 | A | 7/1984 | Larsen | |
| 6,450,465 | B1 * | 9/2002 | Eslick | 248/230.4 |
| 2002/0043221 | A1 * | 4/2002 | Hytonen et al. | 122/428 |
| 2004/0123813 | A1 * | 7/2004 | Haaga et al. | 122/235.12 |
| 2005/0263108 | A1 * | 12/2005 | Engvall | 122/7 R |
| 2009/0014137 | A1 | 1/2009 | Tanttu et al. | |

OTHER PUBLICATIONS

PCT International Search Report and The Written Opinion of the International Searching Authority, dated Mar. 26, 2010—(PCT/US2010/021134).

* cited by examiner

*Primary Examiner* — Kenneth Rinehart
*Assistant Examiner* — Bao D Nguyen
(74) *Attorney, Agent, or Firm* — James J. Cummings

(57) ABSTRACT

An adjustable fuel nozzle assembly [1000] for spraying fuel into a recovery boiler [13] includes at least two fuel nozzle assemblies [1100, 1300]. An adjustment section [1500] adapted to adjust the relative orientation between the nozzle assemblies [1100, 1300] and hold them at the desired orientation relative to each other to create a desired spray pattern. The adjustment section [1500] also adapted to simultaneously aim several fuel nozzles at a target location, retaining their relative orientation between the nozzle assemblies [1100, 1300]. This allows the nozzle assemblies [1100, 1300] to spray fuel with a desired spray pattern to a desired location to properly control combustion of the recovery boiler [13], thereby increasing stability of combustion minimizing the creation of pollutants such as NOx gases.

16 Claims, 4 Drawing Sheets

ADJUSTABLE, MULTIPLE SPLASH PLATE LIQUOR GUNS

TECHNICAL FIELD

The present disclosure relates generally to recovery boilers and more specifically to an adjustable fuel nozzle system for recovery boilers.

BACKGROUND

Recovery boilers are used in various processes, such as manufacturing paper. Some of the organic products used in the process are flammable. Instead of discarding this waste material, it may be burned as a fuel for the boiler. The inorganic chemicals are collected at the bottom of the furnace and are discharged through dedicated openings in the lower furnace into a dissolving tank.

FIG. 1 shows a prior art recovery boiler system 3. Initially a fuel, such as natural gas, is released from gas jets 9 of a burner 7 and ignited. They create combustion in combustion chamber 11.

After the boiler system 3 heats up enough, then fuel is sprayed through fuel nozzles 13 into combustion chamber 11. This fuel may be the organic waste product such as that referred to as "black liquor" created in the paper manufacturing process. Therefore, throughout this document, it is to be understood that fuels nozzles may also be referred to as "liquor guns".

The heated flue gasses rise and heat pipes 5 filled with water. Any smelt from burning other materials will form in the bottom of boiler system 3 and run into a dissolving tank 17.

The droplet size of the fuel sprayed from nozzles 13, the spray pattern, the location where the fuel is introduced, the temperature of the combustion chamber 11 when the fuel was introduced and other factors have an effect on the amount of combustion produced, the subsequent temperature at different locations in the combustion chamber 11, the stability of the combustion and the emissions produced. Therefore, the droplet size and spray distribution of the fuel is very important. Many of these factors are determined by the nozzle design.

The prior art discloses simple fuel nozzles such as the type described in U.S. Pat. No. 4,462,319 issued Jan. 31, 1984 to Larsen. This descried the use of fuel nozzles for recover boilers and relies on the use spray holes to define droplet size. Larsen does not address the positioning of fuel nozzles to regulate the combustion to meet some of the needs listed above.

Currently, there is a need for a fuel nozzle system that allows a user to adjust the location where fuel is sprayed and the distribution of fuel droplets sprayed to increase efficiency and reduce the amount of unwanted pollutant gases created, such as NOx.

SUMMARY

The present invention may be embodied as an adjustable fuel nozzle system for providing fuel to a combustion chamber [111] of recovery boiler [103]. It includes an upper fuel nozzle assembly [1100], a lower fuel nozzle assembly [1300], and an adjustment section [1500].

The upper and lower fuel nozzle assemblies [1100, 1300] each include an inlet line [1110] for receiving said fuel, an extension [1130] having a central conduit for directing said fuel from the inlet line [1110] through the extension [1130] having a first and second end, the first end being fluidically connected to the inlet line [1110], a nozzle outlet [1143] fluidically connected to the second end of the extension [1130] allowing said fuel to exit the extension [1130] as a jet of fuel.

The adjustment section [1500] is adapted to hold both the upper and lower fuel nozzle assemblies [1100, 1300] in a desired orientation relative to each other, and to permit adjustment of the orientation of both the upper and lower fuel nozzle assemblies [1100, 1300] keeping the same desired relative orientation between the nozzle assemblies [1100, 1300].

The proper relative positioning of the fuel nozzle assemblies [1100, 1300] creates a more efficient spray pattern. By adjusting the spray pattern and adjusting the location where the fuel is sprayed may causes the recovery boiler [103] to become more stabile and create less pollutants.

OBJECTS OF THE INVENTION

It is an object of the present invention to reduce pollutant gasses, such as NOx emissions from chemical recover furnaces.

It is another object of the present invention to increase recover boiler firing and stability.

It is another object of the present invention to provide a system for more accurately creating and directing a fuel spray pattern.

It is another object of the present invention to provide a group of fuel nozzles that can be properly aimed together keeping their relative orientation.

It is another object of the present invention to provide a group of fuel nozzles that can be properly aimed together to impinge upon a desired target location.

It is another object of the present invention to provide a group of fuel nozzles in which the relative aim of at least one nozzle may be adjusted relative to the other nozzles to impinge upon a desired target location.

Other objects and advantages of the invention will become apparent from the drawings and specification.

BRIEF DESCRIPTION OF THE DRAWINGS

Referring now to the drawings, wherein like items are numbered alike in the various Figures.

DETAILED DESCRIPTION

As stated in the "Background" above, it is important to be able to adjust the spray pattern of the fuel nozzles. It is also important to position the spray nozzles to cause the boiler run within defined temperatures. The prior art does not address these problems; however, the present invention does.

Figure 1:
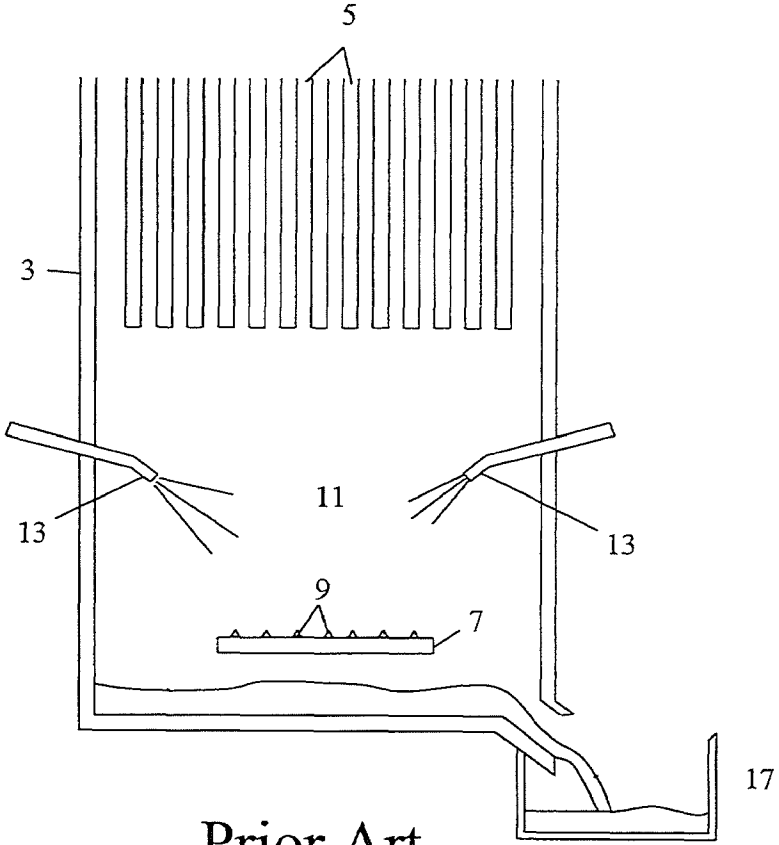
Prior Art Fig. 1
FIG. 1 is a perspective view of a prior art recovery boiler system.
Figure 2:
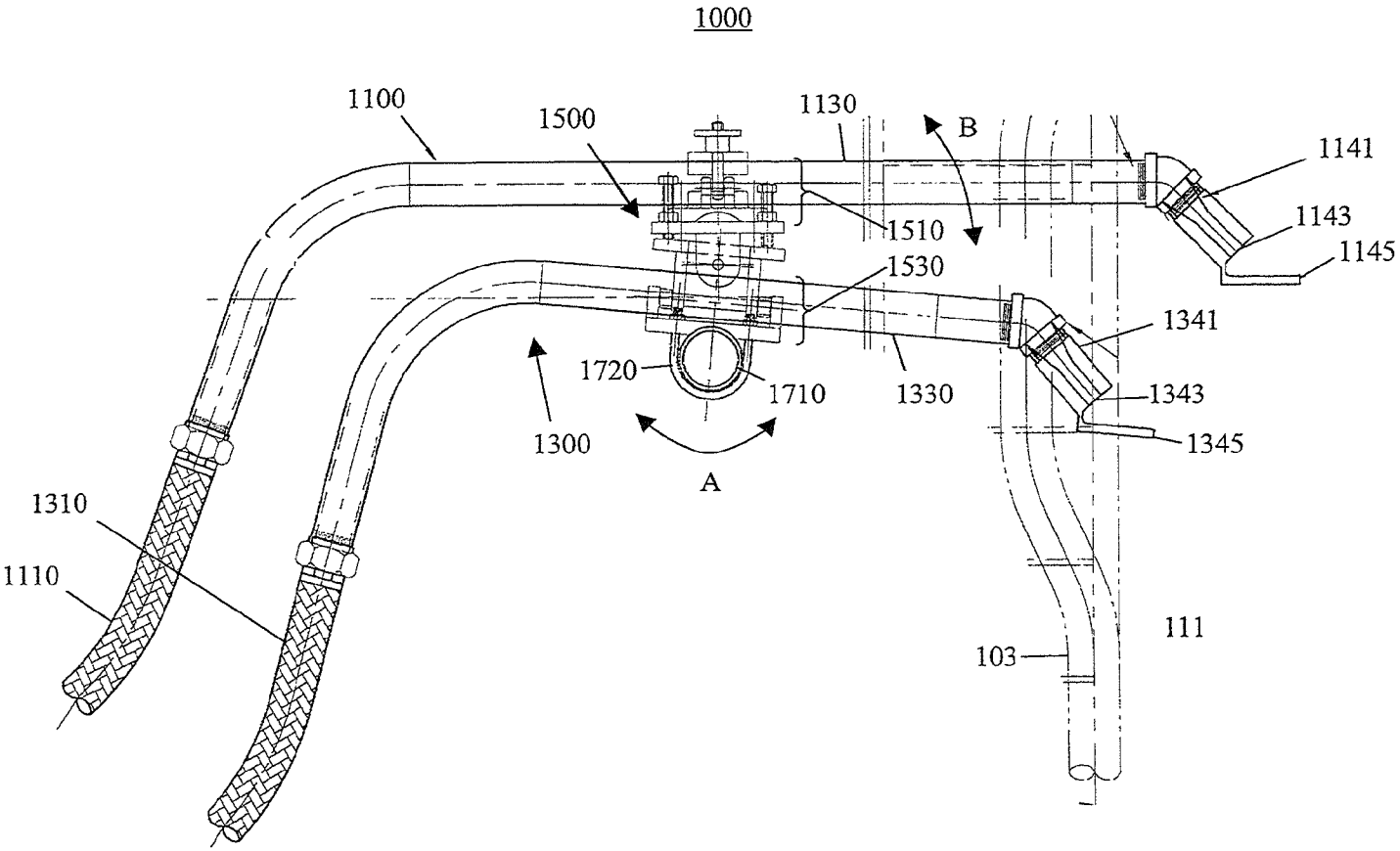
FIG. 2 is an elevational view of one embodiment of an adjustable fuel nozzle system according to the present invention.

FIG. 2 is an elevational view of one embodiment of an adjustable fuel nozzle system according to the present invention. The adjustable fuel nozzle system 1000 has an upper fuel nozzle assembly 1100 and a lower fuel nozzle assembly 1300. Even though two are described here, the invention covers the use of multiple fuel nozzle assemblies.

Each of the fuel nozzle assemblies 1100, 1300 includes an inlet line 1110, 1310 for receiving fuel. The fuel is typically an organic manufacturing byproduct, such as 'black liquor' from a paper manufacturing process.

Extension 1130, 1330 are connected to inlet lines 1110, 1310 and pass the fuel to nozzles 1141, 1341, respectively.

The fuel is sprayed out of nozzle opening 1143, 1343 into a combustion chamber 111 of boiler system 103 for combustion. If fuel is sprayed into the center of a hot flame, a larger amount of gasses such as NOx are created. However, if the fuel is only sprayed at the perimeter of the combustion chamber 111, then it may liquefy and run into the smelt, wasting the fuel and causing additional problems in the smelt.

Therefore, it is best to be able to adjust the location as to where the fuel is being sprayed to control the combustion process.

In other uses, there is an optimum temperature to run the boiler system. Therefore, by altering the location of the fuel nozzles, one may control the boiler system keeping it within the proper range.

It is advantageous to break liquid fuel into small droplets. This causes more surface area and smoother, more complete combustion. One way to break liquid fuel into droplets is to use a spray head with small nozzle holes as described in U.S. Pat. No. 4,462,319 Larsen above. The smaller the hole, the smaller the droplet sizes created. This works well for pure fuel but blocks if solid particles are present in the fuel.

The present invention uses a nozzle with a nozzle opening, but causes the fuel jet exiting the nozzle opening to impinge upon a splash plate. This splash plate functions to break the liquid into small droplets, but is not as prone to blockage.

The present invention employs a plurality of fuel nozzles each having its own splash plate. The idea being that several smaller fuel nozzles would more efficiently spray the fuel into the combustion chamber and provide more uniform coverage.

Further, if the fuel nozzles are adjustable, the spray from one nozzle may be directed to supplement the spray pattern of another fuel nozzle, filling in areas that did not receive spray from the first nozzle. Once this adjustment of one nozzle relative to the second nozzle has been completed, it is desirable to keep them in the same relative position, but only to move them as a group, keeping the same relative orientation between them. The present invention employs such a relative adjustment and a group adjustment.

A relative hinge 1520 is used to adjust one fuel nozzle assembly 1100 relative to another fuel nozzle assembly 1300, and then secure them to keep these in the same orientation relative to each other.

A group rotation hinge 1540 and an anchor hinge 1720 cause both fuel nozzle assemblies 1100, 1300 to be moved together around a group rotation pivot 1541 and an anchor pipe 1710, respectively. This may be done while preserving the relative orientation between the fuel nozzle assemblies 1100, 1300.

Figure 4:
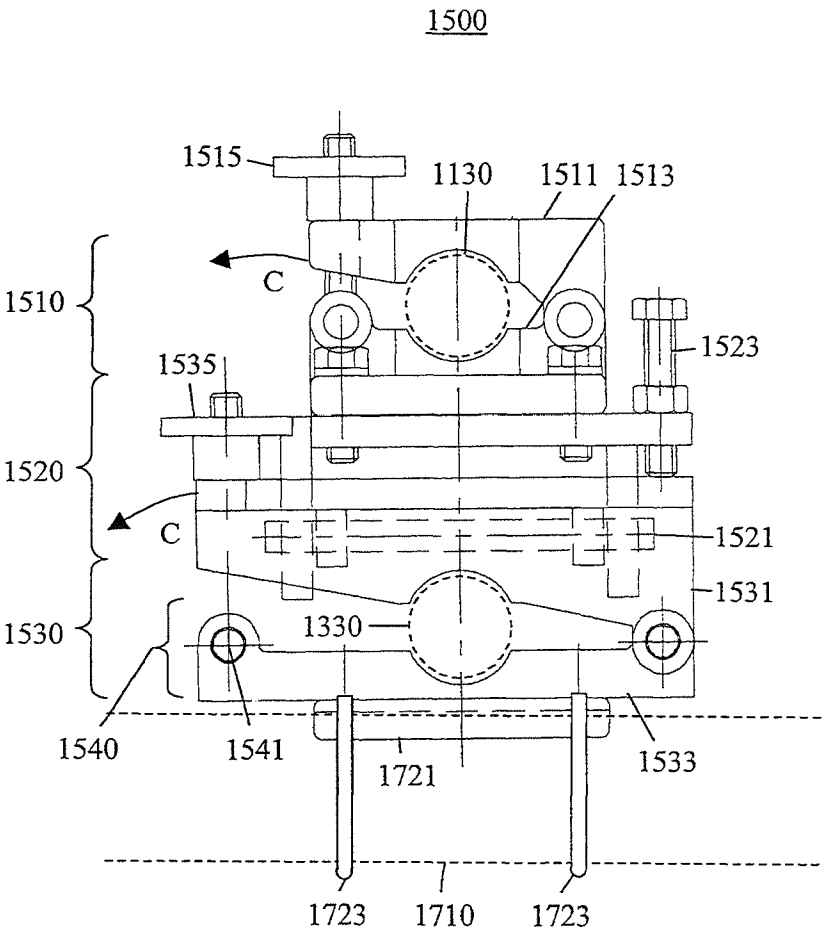
FIG. 4 is an enlarged side elevational view of the adjustment section of the adjustable fuel nozzle system according to the embodiment of the present invention shown in FIGS. 2 and 3.
Figure 3:
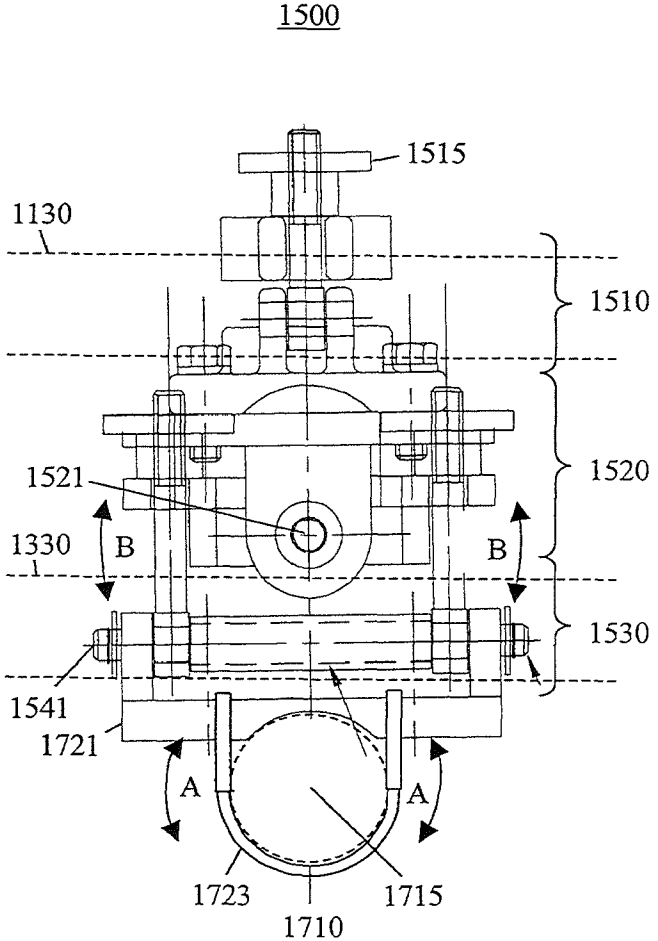
FIG. 3 is an enlarged front elevational view of the adjustment section of the adjustable fuel nozzle system shown in FIG. 2.
Figure 5:
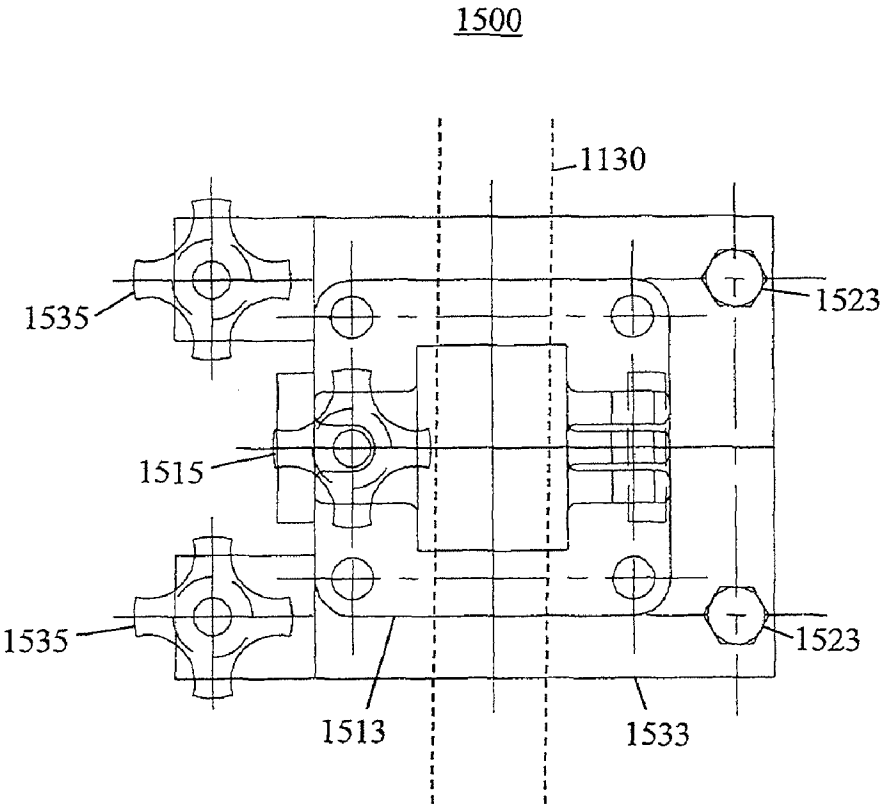
FIG. 5 is a top plan view of the adjustment section of the adjustable fuel nozzle system of the present invention shown in FIGS. 3 and 4.

FIG. 3 is an enlarged front elevational view of the adjustment section of the adjustable fuel nozzle system shown in FIG. 2. FIG. 4 is an enlarged side elevational view of the adjustment section 1500 of the adjustable fuel nozzle system 1000 according to the embodiment of the present invention shown in FIGS. 2 and 3. FIG. 5 is a top plan view of the adjustment section of the adjustable fuel nozzle system of the present invention shown in FIGS. 3 and 4.

The present invention will be described below in connection with FIGS. 3, 4 and 5.

In this embodiment, an upper clamp 1510 clamps around and secures the upper extension 1130, shown here in phantom.

A lower clamp 1530 surrounds and clamps lower extension 1330, also shown in phantom.

Upper clamp 1510 and lower clamp 1530 both are attached to a relative hinge 1520 that pivots about relative hinge pivot 1521 in the direction of the arrow marked "B". This allows upper extension to pivot about relative hinge pivot 1521 altering the relative orientation between upper extension 1130 and lower extension 1330. Adjustment bolts 1523 are screwed in to the proper depth to hold the desired orientation. An additional nut may be screwed down on these to lock them at their position.

The difference in orientation adjusts the area sprayed by nozzle outlet 1143 relative to that sprayed by nozzle outlet 1343 to 'fill in' missed areas, or intensify spray in a desired area.

Going into greater detail, it can be seen that upper clamp 1510 has a clamp top 1511 and a clamp base 1513 that surround upper extension 1130. A thumbscrew 1515 pulls clamp top 1511 to clamp base 1513 securing upper extension 1130 between them.

Similarly, lower clamp 1530 has a clamp top 1531 and a clamp base 1533 that surround lower extension 1330. Thumbscrews 1535 pulls clamp top 1531 to clamp base 1533 securing upper extension 1130 between them.

An anchor pipe 1710 is fixed into a stationery structure and is used to hold the upper and lower fuel nozzle assemblies 1100, 1300 and the adjustment section 1500.

Here two U-bolts 1723 attach anchor pipe to an anchor plate 1721. Anchor plate 1721 is attached to a group rotation hinge 1540. Group rotation hinge 1540 is also attached to clamp base 1531 of the lower clamp 1530.

The U-bolts 1723 may be loosened to pivot the entire assembly (the anchor plate 1721, the group rotation hinge 1540, the lower clamp 1530, the relative hinge 1520 the upper clamp 1510, the lower fuel nozzle assembly 1300 and the upper fuel nozzle assembly 1100) around anchor pipe 1710 about its center 1715 in the direction of the arrows marked "A". The U-bolts 1723 may then be tightened to keep them at that position. In effect, this is acting as a hinge or pivot.

The group rotation hinge 1541 allows the entire assembly above the anchor plate 1721 to pivot in the direction of the arrows marked "C". The axis of rotation of "C" is approximately perpendicular to the axis of rotation of "A".

Rotating according to the directions marked "A" or "C" would keep the same relative orientation between extensions 1130 and 1330, and their respective nozzle outlets 1143 and 1343, while moving both to aim at a different location.

This adjustability results in a system that more accurately adjusts spray patterns, keeps the same spray pattern as the aim of several nozzles are simultaneously adjusted to more accurately maintain the combustion of the boiler system.

Figure 6:
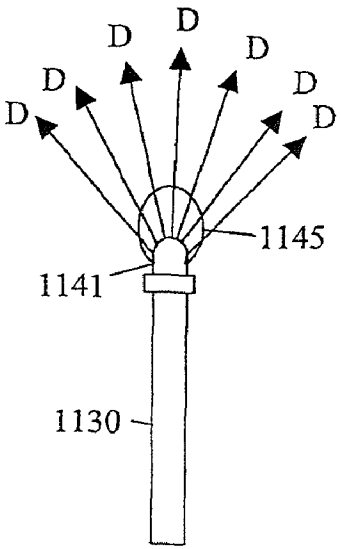
FIG. 6 is a top plan view of a portion of the upper fuel nozzle assembly.

FIG. 6 is a top plan view of a portion of the upper fuel nozzle assembly. Here nozzle 1141 and splash plate 1145 of the end of upper nozzle assembly 1100 are shown. The stream of fuel exiting the nozzle 1141 impact upon the splash plate 1145 and is sprayed as fuel droplets in the directions indicated by the arrows marked "D". This embodiment of the splash plate 1145 is a planar, oval shape. It is attached directly within the stream of fuel flow and is wider than the nozzle 1141 and nozzle opening (1143 of FIG. 2). Its width is selected such that any fuel leaving nozzle 1141 at a slight angle will still impact the splash plate 1145. This is to insure that all fuel is broken into droplets, since fuel that is not broken into droplets causes incomplete combustion, increased pollutants and a loss of efficiency.

The nozzle design of the present invention results in more consistent temperatures, greater combustion stability and reduced creation of pollutants, such as NOx emissions.

Although the invention has been described and illustrated with respect to exemplary embodiments thereof, it should be understood by those skilled in the art that the foregoing and various other changes, omissions and additions may be made therein and thereto, without parting from the spirit and scope of the present invention. Accordingly, other embodiments are within the scope of the following claims.

What is claimed is:

1. An adjustable fuel nozzle system for providing fuel to a combustion chamber of recovery boiler comprising:

a) an upper fuel nozzle assembly, comprising:

i. an inlet line for receiving said fuel, ii. an extension for directing said fuel from the inlet line through the extension having a first and second end, the first end being fluidically connected to the inlet line, iii. a nozzle outlet fluidically connected to the second end of the extension allowing said fuel to exit the extension as a jet of fuel;

b) a lower fuel nozzle assembly, comprising:

i. an inlet line for receiving said fuel, ii. an extension for directing said fuel from the inlet line through the extension having a first and second end, the first end being fluidically connected to the inlet line, iii. a nozzle outlet fluidically connected to the second end of the extension allowing said fuel to exit the extension as a jet of fuel; and c) an adjustment section adapted to hold both the upper and lower fuel nozzle assemblies in a desired orientation relative to each other, and to permit adjustment of the orientation of both the upper and lower fuel nozzle assemblies keeping the same desired relative orientation between the nozzle assemblies;

wherein the adjustment section comprises:

a fixed anchor pipe having a center point;

an anchor clamp for pivotally attaching a lower clamp to the fixed anchor pipe allowing both fuel nozzle assemblies to pivot simultaneously about the center point; and a group rotation hinge attached between the lower clamp and a anchor plate; where the group rotation hinge permits rotation about an axis that is perpendicular to an axis about which rotation about the anchor clamp permits.

2. The adjustable fuel nozzle system of claim 1, wherein the adjustment section further comprises:

an upper clamp adapted to hold the upper fuel nozzle assembly.

3. The adjustable fuel nozzle system of claim 2, wherein the adjustment section further comprises:

the lower clamp adapted to hold the lower fuel nozzle assembly.

4. The adjustable fuel nozzle system of claim 3, wherein the adjustment section further comprises:

a relative hinge having a relative hinge pivot coupled between the upper clamp and the lower clamp allowing the upper clamp to rotate about the relative hinge pivot to change the relative orientation between the upper fuel nozzle assembly and the lower fuel nozzle assembly.

5. The adjustable fuel nozzle system of claim 4, wherein the group rotation hinge permits both fuel nozzle assemblies to pivot simultaneously about the group rotation hinge.

6. The adjustable fuel nozzle system of claim 4, wherein the adjustment section further comprises:

adjustment bolts between the relative hinge and the lower clamp adapted to hold the relative hinge at its desired orientation.

7. The adjustable fuel nozzle system of claim 1, wherein the anchor clamp comprises:

at least one U-bolt.

8. The adjustable fuel nozzle system of claim 1, wherein the upper clamp comprises:

a) a clamp top having fitting over the top of the upper fuel nozzle assembly, b) a clamp base fitting around the bottom of the upper fuel nozzle assembly, c) an attachment means attaching the clamp top to the clamp base to secure the upper fuel nozzle assembly.

9. The adjustable fuel nozzle system of claim 1, wherein the lower clamp comprises:

a) a clamp top having fitting over the top of the lower fuel nozzle assembly, b) a clamp base fitting around the bottom of the lower fuel nozzle assembly, c) an attachment means attaching the clamp top to the clamp base to secure the lower fuel nozzle assembly.

10. An adjustable fuel nozzle system for providing fuel to a combustion chamber of recovery boiler comprising:

a) a plurality of fuel nozzle assemblies, each fuel nozzle assembly comprising:

i. an inlet line for receiving said fuel, ii. an extension for directing said fuel from the inlet line through the extension, the extension having a first and second end, the first end being fluidically connected to the inlet line, iii. a nozzle outlet fluidically connected to the second end of the extension allowing said fuel to exit the extension as a jet of fuel; and b) a group rotation hinge coupled to the plurality of fuel nozzle assemblies, the group rotation hinge capable of collectively adjusting the orientation of the nozzle outlets to aim them at a desired target location within said combustion chamber;

an adjustment section comprising:

a fixed anchor pipe having a center point;

an anchor clamp for pivotally attaching a lower clamp to the fixed anchor pipe allowing both fuel nozzle assemblies to pivot simultaneously about the center point; where the group rotation hinge permits rotation about an axis that is perpendicular to an axis about which rotation about the anchor clamp permits.

11. The adjustable fuel nozzle system of claim 1, further comprising:

at least two splash plates each positioned proximate to a different nozzle outlet such that the jet of fuel exiting the nozzle outlet impacts onto the respective splash plate causing said jet of fuel to splatter into a spray of fuel directed toward a desired location within said combustion chamber.

12. The adjustable fuel nozzle system of claim 10, further comprising:

a splash plate positioned adjacent the nozzle outlet such that the jet of fuel exiting the nozzle outlet impinges upon the splash plate, is broken into spray droplets which enter said combustion chamber.

13. The adjustable fuel nozzle system of claim 10, further comprising:

a relative hinge, adapted to adjust the orientation of the at least one fuel nozzle outlet relative to at least one other nozzle outlet.

14. The adjustable fuel nozzle system of claim 10, wherein:

the fuel nozzle assemblies are positioned substantially vertically above each other.

15. The adjustable fuel nozzle system of claim 1, further comprising a splash plate, wherein the splash plate is substantially planar.

16. The adjustable fuel nozzle system of claim 11, wherein the splash plates are wider than the nozzle outlet, insuring that the entire jet of fuel impinges upon the splash plates.

* * * * *